United States Patent [19]

Dottore, Jr.

[11] 4,164,936

[45] Aug. 21, 1979

[54] DAMPER

[76] Inventor: Nicholas J. Dottore, Jr., 34460 Parkview Dr., Willoughby Hills, Ohio 44094

[21] Appl. No.: 825,571

[22] Filed: Aug. 18, 1977

[51] Int. Cl.[2] ..... F23N 3/00

[52] U.S. Cl. ..... 126/285 R; 126/285.5; 236/68 A

[58] Field of Search ..... 126/285 R, 285 B, 293; 236/1 G, 68 R, 68 A; 110/163; 431/20

[56] References Cited

U.S. PATENT DOCUMENTS

| | | | |
|---|---|---|---|
| 1,549,653 | 8/1925 | Corson | 126/285 B |
| 2,259,973 | 10/1941 | Firehammer | 236/1 G X |
| 2,761,494 | 9/1956 | Field | 431/20 |
| 3,976,244 | 8/1976 | Logsdon | 236/68 R X |
| 4,005,820 | 2/1977 | Cress | 236/1 G |
| 4,076,171 | 2/1978 | Swenson | 126/285 R X |
| 4,084,743 | 4/1978 | Matthews et al. | 236/1 G |

*Primary Examiner*—Dennis L. Taylor
*Attorney, Agent, or Firm*—Maky, Renner, Otto & Boisselle

[57] ABSTRACT

A damper assembly constructed to close a flue pipe for a burner during non-use of the burner and to automatically open prior to burner ignition. An actuator operated by a thermo-statically controlled heater and an expansible fluid, rotates a baffle of the damper assembly to open the flue pipe. A safety interlock requires the baffle to be opened before the burner is ignited. When the burner is turned off, the actuator delays closing of the baffle for a time to allow exhausting of residual combustion products. In one embodiment, two baffles are operated to close a flue pipe above and below a draft diverter.

8 Claims, 3 Drawing Figures

DAMPER

BACKGROUND OF THE INVENTION

1. Field of the Invention

This invention relates to automatically operated dampers for burner flues.

2. Prior Art.

The typical flue from the burner of a hot water tank or furnace continually provides a free path for the flow of waste products of combustion. As a result, residual heat is lost from the heat exchanger by the stack effect of the flue, due to the continued flow of ambient air that enters the burner area and leaves through the stack after combustion has stopped. In addition, heat from the water in a hot water tank is lost to cooler air flowing through the portion of the flue that extends up the center of the tank. Moreover, a hot water tank flue typically has a draft diverter that, while limiting the stack effect or upward flow through the central flue of the tank, allows air to be drawn from the room, and ambient heat is lost through the flue. As a result of heat loss from furnaces and hot water tanks, fuel requirements are increased and the efficiency of operation is decreased. Such inefficiencies and the loss of heated room air has become a serious problem with the shortages and high cost of fuels.

Draft retarders are known for use in flues of heating systems. For example, U.S. Pat. No. 3,934,796 shows a solenoid operated damper energized by a heating system for automatic operation in a flue of the system. U.S. Pat. No. 3,010,451 shows a smoke pipe damper controlled by an electrically operated hydraulic motor. Other examples of automatically operated dampers are shown by U.S. Pat. Nos. 3,396,777 and 2,508,885. These arrangements utilize actuators that have disadvantageous characteristics and lack safety features and other advantages of the present invention, and fail to prevent heat loss associated with draft diverters.

SUMMARY OF THE INVENTION

The present invention provides in one embodiment a damper assembly for an uninterrupted flue, such as a furnace flue, and in another embodiment provides a damper assembly for use with a draft diverter, as typically used with hot water heaters. The damper assembly of the present invention provides a baffle or baffles that are spring biased closed and operated through linkages by a thermostatically controlled actuator to open an associated flue. Importantly, the actuator is energized without sparking or arcing, which is dangerous in an environment where fuel fumes may exist, and operates with a slow rather than snap action, to avoid noise and stress upon operating linkages. The operation of the actuator, when closing the baffle, includes a delay to allow combustion products to be drafted out of the burner for a period of time sufficient to eliminate the trapping of smoke or fumes.

More specifically, a cylinder and piston type actuator is used to operate the baffle or baffles of the damper assembly, the piston being fluid operated to extend a rod by the vaporization of a fluid, such as Freon, by a thermostatically controlled heater. The piston is spring returned when the heater is deactivated and the vaporized gas condenses. This construction provides an inherent delay in operation and a gradual movement during actuation.

A safety interlock is provided to assure that the burner with which the damper assembly is used does not operate with the baffle closed. This is achieved by a switch operated when the baffle is moved between opened and closed positions and which prevents the supplying of fuel to the burner until the baffle is open.

A further safety feature is achieved from the use of the heat-operated actuator by locating the actuator directly adjacent the flue that is baffled. In the event of a build up of heat in the burner and flue area due, for example, to the starting of the burner (for example, due to a gas leak or failure of the fuel valves upstream of the burner) without the damper or dampers being opened, a dangerous situation would result. However, as heat builds up, the temperature of the actuator rises, causing the expansible fluid within the actuator to expand and open the baffle or baffles without actuation through the thermostatically controlled electrical system.

With the present invention installed on a furnace flue, a single baffle retards loss of heat from the heat exchanger of the furnace after burner operation. This allows the blower of the furnace to circulate the residual heat in the furnace throughout the heating system without loss to air drafted through the furnace flue. The baffle also prevents flow of furnace room air through the furnace flue.

With the present invention in use with a draft diverter, as with a hot water heater, two baffles are operated by the same actuator to close the flue above and below the draft diverter. Convective air flow through the lower flue that extends through the center of the hot water tank is prevented, retarding loss of heat that otherwise occurs from the heated water to the flow of air. Closing of the upper flue prevents the flow of room air through the draft diverter and up the flue pipe. The damper of the present invention, thus, provides a safe and effective way to automatically prevent the loss of heat through burner flues.

The above and other features and advantages of the present invention will become better understood from the detailed description that follows, when considered in connection with the accompanying drawings.

DETAILED DESCRIPTION OF A PREFERRED EMBODIMENT

Figure 1:
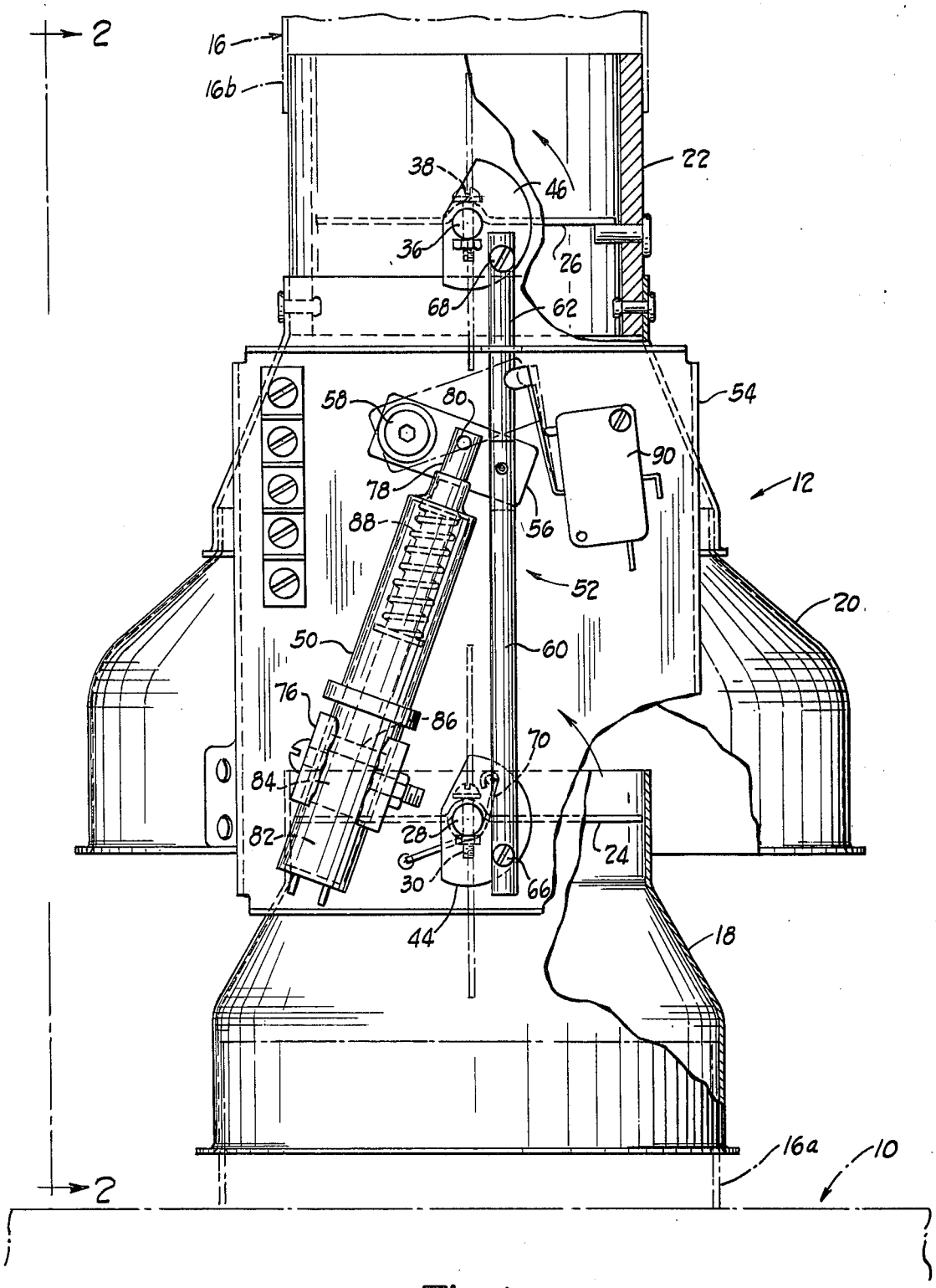
FIG. 1 is a front elevational view, with parts in section, of a damper assembly embodying the present invention, in which two baffles are provided for a draft diverter of the type used with hot water heaters.
Figure 2:
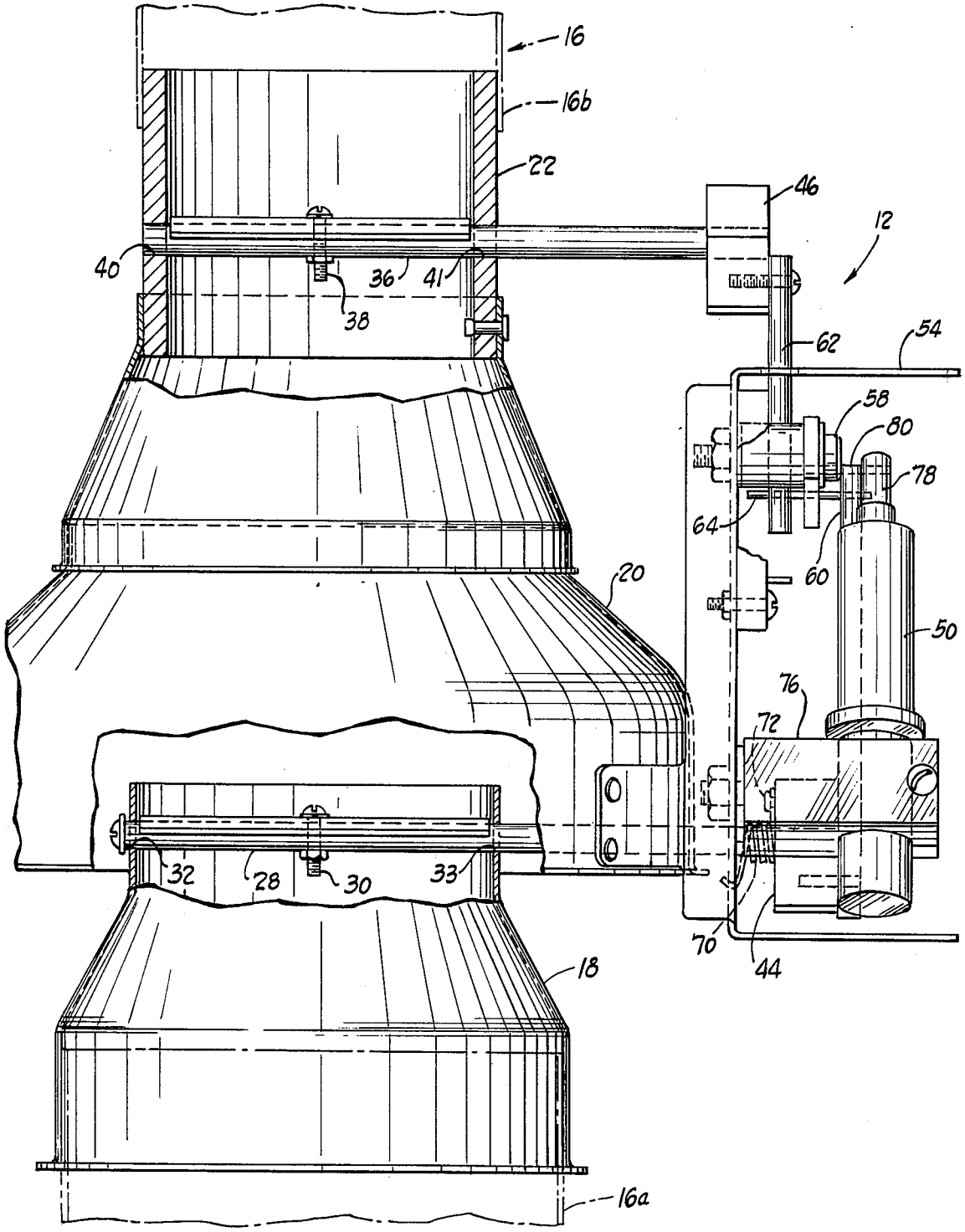
FIG. 2 is a side elevational view of the damper assembly of FIG. 1.

With reference to FIGS. 1 and 2 of the drawings, a water heater 10 is indicated in phantom, with a damper assembly 12 that embodies the present invention. The damper assembly is incorporated into a draft diverter 14 connected in a flue pipe 16 of the hot water heater. The lower part **16*a* of the flue pipe extends through the center of the hot water tank from a burner below. An upper part 16*b* extends from the top of the damper assembly 12**.

The draft diverter 14 includes a lower mounting piece 18 that fits over the flue portion **16*a*, and an upper hood 20 riveted to a collar 22** that connects to the upper part 16*b* of the flue pipe 16. The hood 20 provides a passage from the lower flue pipe 15*a* to the upper pipe 16*b* and also provides a communication through its lower opening 20*a* from the ambient atmosphere to the flue 16.

The damper assembly 12 includes two circular baffles, a lower baffle 24 within the mounting piece 18 and an upper baffle 26 within the collar 22. The lower baffle is supported on a shaft 28 by a screw 30. The shaft is journaled in openings 32, 33 (FIG. 2) in the mounting piece. The upper baffle is supported on a shaft 36 by a screw 38. The shaft is journaled for rotation in openings 40, 41 in the collar 22.

The shaft 28 extends laterally through the hood 20 and the extending end supports a wheel sector 44. The shaft 36 extends laterally in the same direction as the lower shaft, and supports a wheel sector 46 on the extending end. Both sectors function as bell crank levers to rotate the respective shafts 28, 36.

An actuator 50 and a linkage 52 are carried by a support bracket 54 mounted to the hood 20 for rotating the shafts 28, 36 to move the baffles between opened and closed positions.

The actuating linkage 52 includes an arm 56 pivoted at one end by a screw 58 to the bracket 54. The arm carries links 60, 62 on opposite sides, secured by a cross pin 64. The link 60 extends downwardly to the sector 44, where it is pivotally secured by a screw 66. The link 62 extends upward from the arm to the sector 46, where it is pivotally secured by a screw 68.

A coil spring 70 encircles the shaft 28 adjacent the wheel sector 44. One end of the spring is secured to the bracket 54 and the other end to the sector 44 by a stud 72. The spring biases the sector and hence the linkage 52 and thus both shafts 28, 36 in a direction (indicated by arrows in FIG. 1) that rotates the baffles 24, 26 to an open position, as shown in phantom in FIG. 1. Thus, in the event of a failure linkage 52, the baffles will be biased open.

The actuator 50 is adjustably held by a clamp 76 bolted to the bracket 54. The actuator has an extensible rod 78 pivotably secured to the arm 56 by a pin 80 intermediate the pivot screw 58 and cross pin 64. The actuator is comprised of an electrical heater 82 in the end adjacent the bracket 76, and a chamber 84 in which a piston 86 on the rod 78 moves. An internal compression spring 88 biases the rod 78 into the actuator body. An expansible fluid, such as Freon that will readily vaporize with heat, is in the chamber 84 and serves to move the rod 78 outward when the heater 82 is energized, to pivot the arm 56 from the solid position shown in FIG. 1 to the phantom position. Pivoting of the arm moves the links 60, 62 and pivots the baffles 24, 26 from the solid line position to the phantom line position of FIG. 1. A particularly suitable actuator 50 is the Gould refrigerant actuator manufactured by Gould Inc.

A microswitch 90 is secured to the bracket 54 in a position to be actuated by movement of the arm 56. The microswitch is a part of a safety interlock for the operation of the burner of the hot water tank, so the burner will not operate when the baffles 24, 26 are closed.

Figure 3:
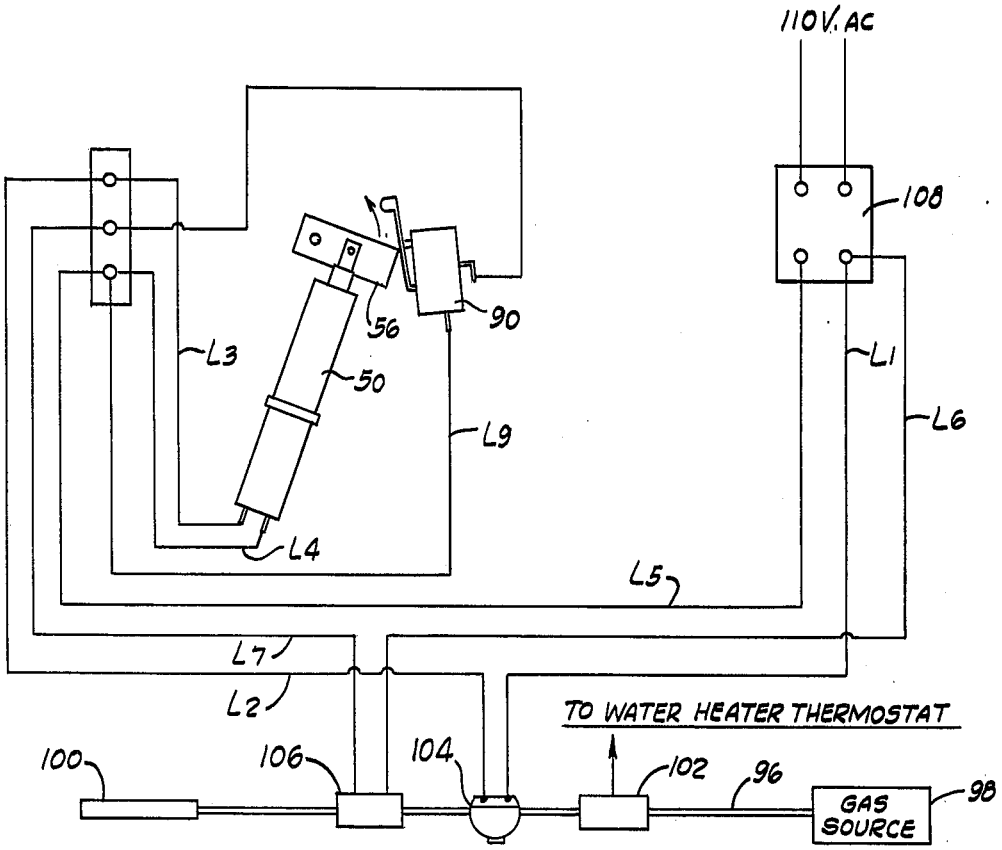
FIG. 3 is a diagrammatic showing of a control system for a hot water heater utilizing the damper shown in FIGS. 1 and 2, for automatically controlling the baffles.

A control system for the operation of the damper assembly 12 when used with a hot water heater is shown in FIG. 3. A fuel line 96 is diagrammatically shown extending from a source of fuel 98, such as a gas main, to a gas burner 100 of the hot water heater. The fuel line includes a first thermostat-operated gas valve 102, a pressure-operated electric switch 104 downstream from the gas valve 102, and a solenoid-actuated second gas valve 106 downstream from the pressure-operated electric switch. The first gas valve 102 is connected to and operated by the thermostat of the hot water heater and is opened when the thermostat indicates the temperature of the water in the tank is below a certain level. The valve closes when the water has been heated to a desired level. The pressure operated switch 104 is connected in series with a 24 volt power transformer 108 and the heater 84 of the actuator 50 through electrical lines L1, L2, L3, L4 and L5. The transformer 108 is connected directly to a 110 volt AC source. When the first gas valve 102 is opened by the hot water tank thermostat, the pressure operated switch 104 is closed by virtue of the increase in fuel pressure, and causes the heater 84 of the actuator 50 to heat the expansible fluid, which expands to extend the rod 78, swinging the baffles 24, 26 to their opened positions.

The solenoid of the second gas valve 106 is connected in series with the transformer 108 and the microswitch 90 through lines L6, L7, L8, L9 and L5. When the arm 56 reaches the phantom position shown in FIG. 1 through operation of the actuator 50, the microswitch 90 is closed and the solenoid of the second gas valve 106 is actuated to open the valve to allow fuel to flow to the burner 100, which is pilot-operated and ignites. Thus, only after the baffles 24, 26 have been moved to their open position can the burner receive fuel. It will also be apparent that if for some reason the actuator 50 fails while the burner is operated and closes the baffles, the switch 90 will be deactuated, closing the gas valve 106, shutting off the burner 100.

When the thermostat of the hot water heater indicates that the temperature of the water has reached the desired level, the first gas valve 102 is closed, stopping the supply of fuel to the burner 100. The pressure operated switch 104 senses the decrease in fuel pressure and opens the electrical circuit to the heater 82 of the actuator and the expansible fluid in the actuator cools. During the time of cooling, the baffles 24, 26 initially remain open and then gradually close, while residual products of combustion escape through the flue. In the case of gas burners, approximately 25 seconds is allowed for closing, to provide adequate time for the products of combustion to vent from the burner and the hot water tank flue portion 16*a*. In the case of a system using an oil burner, a longer delay is established, on the order of 2½ minutes, because oil has a smoldering effect that requires longer to exhaust the residual products of combustion.

Once the burner has turned off and the baffles have closed, further draft through the flue pipe 16 is prevented and loss of heat from the hot water due to convection through the flue pipe 16*a* and loss of ambient heat from the surrounding area through the hood 20*a* is prevented.

The construction of the actuator 50 provides a safety feature in addition to those described above, because of the heat responsive operation of the actuator and the location proximate to the flue. In the event of a buildup of heat in the flue, due to an improper operation of the burner by a flow of fuel under pressure insufficient to operate the pressure switch 104, as by a relatively slow leak through the gas valves, and thus without actuating the heater 82 of the actuator, the dampers 24, 26 would not be open and a dangerous situation would result. However, the buildup of heat in the flue would be sensed by the actuator, causing the expansible fluid within the actuator to expand and open the baffles.

It will be apparent from the description of the actuator and its operation that the extension of the rod 78 is gradual so as not to stress the parts, and is quiet. There are no contacts or spark gaps associated with the actuator that might result in sparking, as for example with an electric motor, and the actuator is therefore safe in an environment where there may be combustible fumes.

In the event a draft diverter is not used with the burner, as is the case with most furnaces, it will be readily apparent that the hood 20, collar 22 and the upper baffle 26 and associated link 62 can be omitted without changing the remaining structure or operation.

By way of example to illustrate the effectiveness of the present invention in saving fuel, a hot water heater was tested by filling the heater with water and keeping it to its heated condition without drawing water. For a five day period, without the damper assembly 12 in place, 158 cubic feet of gas was used as fuel to maintain the temperature of the tank. With the damper assembly 12 installed, and the remaining conditions being essentially the same (with obvious minor changes in environmental conditions) 51 cubic feed of gas was used for a five day period to maintain the temperature of the water. With the damper assembly in place, the water heater burner did not turn on during the five day period in which there was no use of the water in the tank. Rather, the heat from the pilot light kept the water hot for the test period of time. Without the damper assembly, it was necessary for the burner to operate intermittently to maintain the temperature.

While a preferred embodiment of the invention has been described in detail, it will be apparent that modifications or alterations may be made therein without departing from the spirit and scope of the invention set forth in the appended claims.

What is claimed is:

1. A damper assembly comprising:

a baffle pivotably supported for movement between two positions;

an actuator for pivoting the baffle, said actuator having a heater, an expansible fluid undergoing a fluid to vapor expansion phase change during heating and a vapor to fluid contraction phase change during cooling and a member movable in response to expansion and contraction of said fluid;

a linkage between said movable member and the baffle to pivot the baffle between said two positions in response to movement of said actuator member and a switch located to be actuated in response to movement of said movable member, so its conductive condition is responsive to the position of the baffle.

2. A damper assembly and safety interlock for use with a flue of a fuel burner, comprising:

a conduit portion to form a part of said flue;

a baffle pivotably supported in said portion for movement between a position where it closes the portion and a position where the portion is open;

an actuator for pivoting the baffle, said actuator having a heater, an expansible fluid undergoing a fluid to vapor expansion phase change during heating and a vapor to fluid contraction phase change during cooling and a member movable in response to expansion and contraction of said fluid;

means supporting the actuator adjacent said conduit portion;

a linkage between said movable member and the baffle to pivot the baffle between said two positions in response to movement of said actuator member;

a switch operable between conductive and nonconductive modes in response to operation of the actuator; and a fuel valve for supplying fuel to said fuel burner, said fuel valve being operable to supply fuel only when said switch is in one of its said modes.

3. A damper assembly, fuel supply system and safety interlock for a thermostat-controlled fuel burner having a flue, comprising:

a conduit portion to form a part of said flue;

a baffle pivotably supported in said portion for movement between a position where it closes the portion and a position where the portion is open;

an actuator for pivoting the baffle, said actuator having a heater, an expansible fluid undergoing a fluid to vapor expansion phase change during heating and a vapor to fluid contraction phase change during cooling and a member movable in response to expansion and contraction of said fluid, and arranged to move said baffle toward the position where the portion is open when the actuator is operated;

means supporting the actuator adjacent said conduit portion;

a linkage between said movable member and the baffle to pivot the baffle between said two positions in response to movement of said actuator member;

a first switch operable between conductive and nonconductive modes in response to operation of the actuator;

a thermostat-operated first fuel valve in a fuel line between a source of fuel and the burner, operable to open and close to control flow of fuel through the line in response to conditions of the thermostat;

a pressure-operated second switch operable between electrically conductive and nonconductive modes in response to pressure in said fuel line between the fuel valve and the burner to electrically energize the actuator heater;

whereby the burner is operable only when the actuator is energized and the baffle remains in an open position.

4. A damper assembly as set forth in claim 3 wherein said actuator remains actuated for a predetermined time after energizing current to the actuator and fuel to the burner are discontinued, whereby the baffle remains open for a predetermined time after the thermostat-operated first fuel valve is closed and burner operation has stopped.

5. A damper assembly comprising:

two baffles arranged in series, each pivotably supported for movement between two positions;

an actuator for pivoting both baffles concurrently, said actuator having a heater, an expansible fluid undergoing a fluid to vapor expansion phase change during heating and a vapor to fluid contraction phase change during cooling and a member movable in response to expansion and contraction of said fluid;

a linkage between said movable member and both baffles to pivot the baffles together between said two positions in response to movement of said actuator member; and a switch located to be actuated by movement of said movable member, so its conductive condition is responsive to the position of the baffles.

6. A damper assembly and safety interlock for use with a flue of a fuel burning, comprising:

a conduit portion to form part of said flue, said conduit portion having an opening intermediate its ends for entry of ambient air;

two baffles one before and one after said opening, each pivotably supported in said portion for movement between a position where it closes the portion and a position where the portion is open;

an actuator for pivoting both baffles concurrently, said actuator having a heater, an expansible fluid undergoing a fluid to vapor expansion phase change during heating and a vapor to fluid contraction phase change during cooling and a member movable in response to expansion and contraction of said fluid;

means supporting the actuator adjacent said conduit portions;

a linkage between said movable member and the baffles to pivot the baffles together between said two positions in response to movement of said actuator member;

a switch operable between conductive and nonconductive modes in response to operation of the actuator; and a fuel valve for supplying fuel to said fuel burner, said fuel valve being operable to supply fuel only when said switch is in one of its said modes.

7. A damper assembly, fuel supply system and safety interlock for a thermostat-controlled fuel burner having a flue, comprising:

a conduit portion to form a part of said flue, said conduit portion having an opening intermediate its ends for entry of ambient air;

two baffles, one before and one after said opening, each pivotably supported in said portion for movement between a position where it closes the portion and a position where the portion is open;

an actuator for pivoting both baffles concurrently, said actuator having a heater, an expansible fluid undergoing a fluid to vapor expansion phase change during heating and a vapor to fluid contraction phase change during cooling, and a member movable in response to expansion and contraction of said fluid, and arranged to move said baffles toward the position where the portion is open when the actuator is operated;

means supporting the actuator adjacent said conduit portion;

a linkage between said movable member and both baffles to pivot the baffles between said two positions in response to movement of said actuator member;

a first switch operable between conductive and nonconductive modes in response to operation of the actuator;

a thermostat-operated first fuel valve in a fuel line between a source of fuel and the burner, operable to open and close to control flow of fuel through the line in response to conditions of the thermostat;

a pressure-operated second switch operable between electrically conductive and nonconductive modes in response to pressure in said fuel line between the fuel valve and the burner to electrically energize the actuator heater; and a second fuel valve in the fuel line between the burner and the location in the fuel line where the pressure is sensed by the pressure-operated switch, said second fuel valve being operable electrically in response to actuation of said first switch when the baffles are moved to positions where the conduit portion is open to allow flow of fuel to the burner;

whereby the burner is operable only when the actuator is energized and the baffles remain in open positions.

8. A damper assembly as set forth in claim 7 wherein said actuator remains actuated for a predetermined time after energizing current to the actuator and fuel to the burner are discontinued, whereby the baffles remain open for a predetermined time after the thermostat-operated first fuel valve is closed and burner operation has stopped.

* * * * *